US008974740B2

(12) United States Patent
Stanavich

(10) Patent No.: US 8,974,740 B2
(45) Date of Patent: Mar. 10, 2015

(54) EXHAUST TREATMENT COMPONENT MOUNTING SYSTEM

(71) Applicant: Tenneco Automotive Operating Company Inc., Lake Forest, IL (US)

(72) Inventor: John Stanavich, Chelsea, MI (US)

(73) Assignee: Tenneco Automative Operating Company Inc., Lake Forest, IL (US)

( * ) Notice: Subject to any disclaimer, the term of this patent is extended or adjusted under 35 U.S.C. 154(b) by 165 days.

(21) Appl. No.: 13/795,430

(22) Filed: Mar. 12, 2013

(65) Prior Publication Data

US 2014/0271386 A1 Sep. 18, 2014

(51) Int. Cl.

*B01D 50/00* (2006.01)
*F01N 13/00* (2010.01)
*F01N 13/18* (2010.01)

(52) U.S. Cl.

CPC ..... *F01N 13/1805* (2013.01); *F01N 13/0097* (2014.06); *F01N 13/1855* (2013.01); *F01N 13/1894* (2013.01); *F01N 2450/24* (2013.01)
USPC ..... 422/180; 422/177; 422/170

(58) Field of Classification Search

USPC ..... 422/168, 177, 180, 170; 55/523; 285/29
See application file for complete search history.

(56) References Cited

U.S. PATENT DOCUMENTS

| | | | | |
|---|---|---|---|---|
| 4,250,146 | A * | 2/1981 | Bailey | 422/179 |
| 2004/0031264 | A1* | 2/2004 | Kojima | 60/311 |
| 2004/0060763 | A1* | 4/2004 | Stodolka | 180/309 |
| 2004/0213707 | A1 | 10/2004 | Prommersberger et al. | |
| 2005/0115224 | A1* | 6/2005 | Kojima | 60/282 |
| 2009/0087354 | A1 | 4/2009 | Lawrukovich | |
| 2011/0155263 | A1 | 6/2011 | Mitsuda et al. | |
| 2011/0167807 | A1* | 7/2011 | Mitsuda | 60/311 |
| 2012/0222413 | A1 | 9/2012 | Golin et al. | |
| 2012/0311984 | A1* | 12/2012 | Mitsuda | 55/508 |

FOREIGN PATENT DOCUMENTS

JP 2010-043576 2/2010

* cited by examiner

*Primary Examiner* — Tom Duong
(74) *Attorney, Agent, or Firm* — Harness, Dickey & Pierce, P.L.C.

(57) ABSTRACT

An exhaust treatment component mounting system including an exhaust treatment component canister that includes a cleat ring, and an exhaust treatment component housing including a radially outwardly extending flange. A torsion rod including a first end that mates with the flange of the housing, and a second end including a coupling that mates with the cleat ring, wherein during connection between the first end and the second end of the torsion rod, the canister is rigidly secured to the housing.

21 Claims, 5 Drawing Sheets

EXHAUST TREATMENT COMPONENT MOUNTING SYSTEM

FIELD

The present disclosure relates to an exhaust treatment component mounting system.

BACKGROUND

This section provides background information related to the present disclosure which is not necessarily prior art.

Combustion engines are known to produce emissions that may be harmful to the environment. In an effort to decrease the environmental consequences that an engine may have, exhaust after-treatment systems have undergone extensive analysis and development. Various components that assist in treating engine emission include particulate filters and oxidation and reduction catalysts.

Over time, some of the various exhaust after-treatment elements may require removal and servicing. For example, in the case of a particulate filter, the particulate filter may need to be serviced after it builds up a certain amount of soot. One way of accomplishing this is to make the various after-treatment components removable from the assembly.

SUMMARY

This section provides a general summary of the disclosure, and is not a comprehensive disclosure of its full scope or all of its features.

The present disclosure provides an exhaust treatment component mounting system including an exhaust treatment component canister that includes a cleat ring, and an exhaust treatment component housing including a radially outwardly extending flange. A torsion rod including a first end that mates with the flange of the housing, and a second end including a coupling that mates with the cleat ring, wherein during connection between the first end and the second end of the torsion rod, the canister is rigidly secured to the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
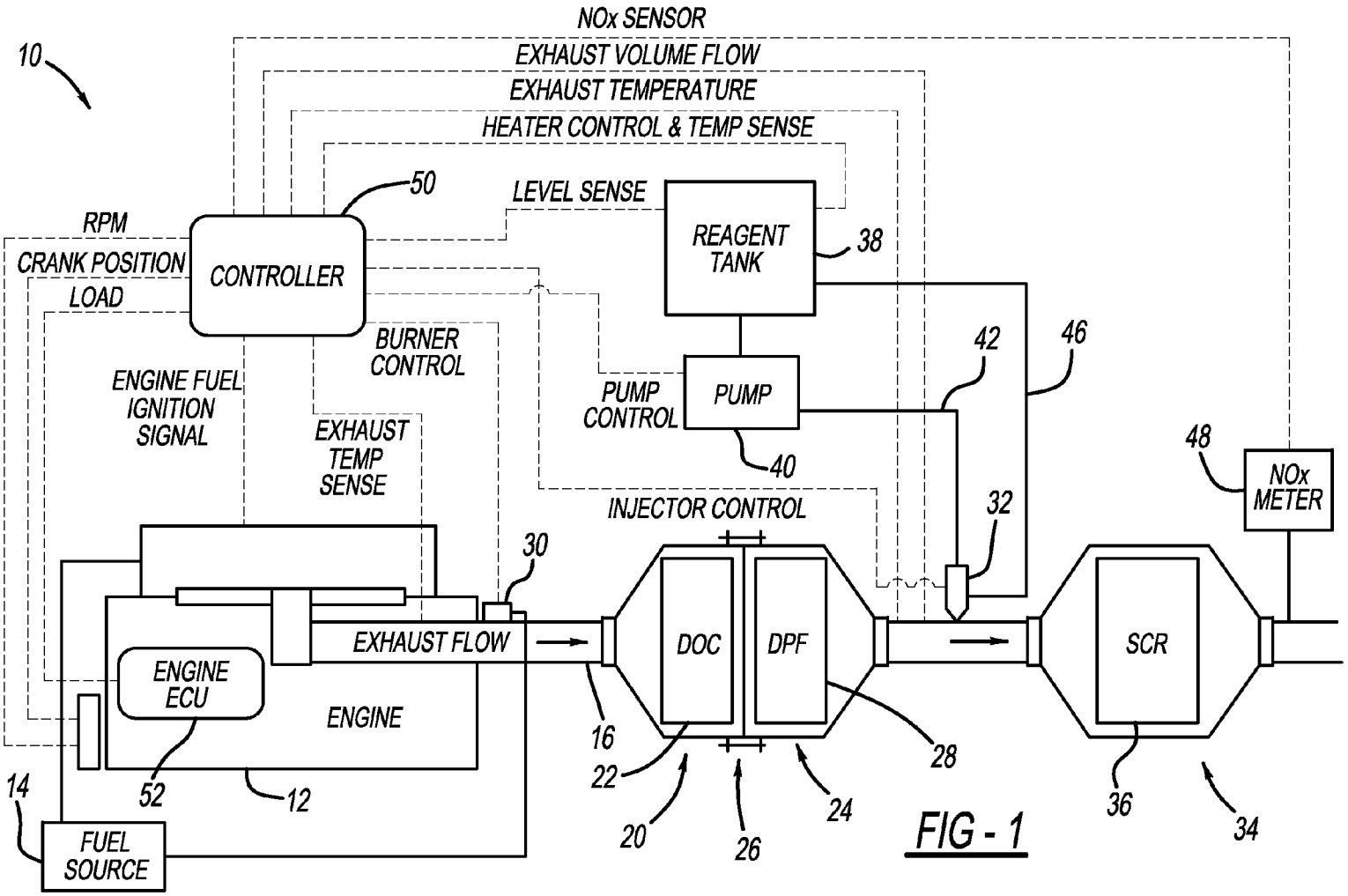
FIG. 1 is a schematic representation of an exhaust system according to a principle of the present disclosure.
Figure 2:
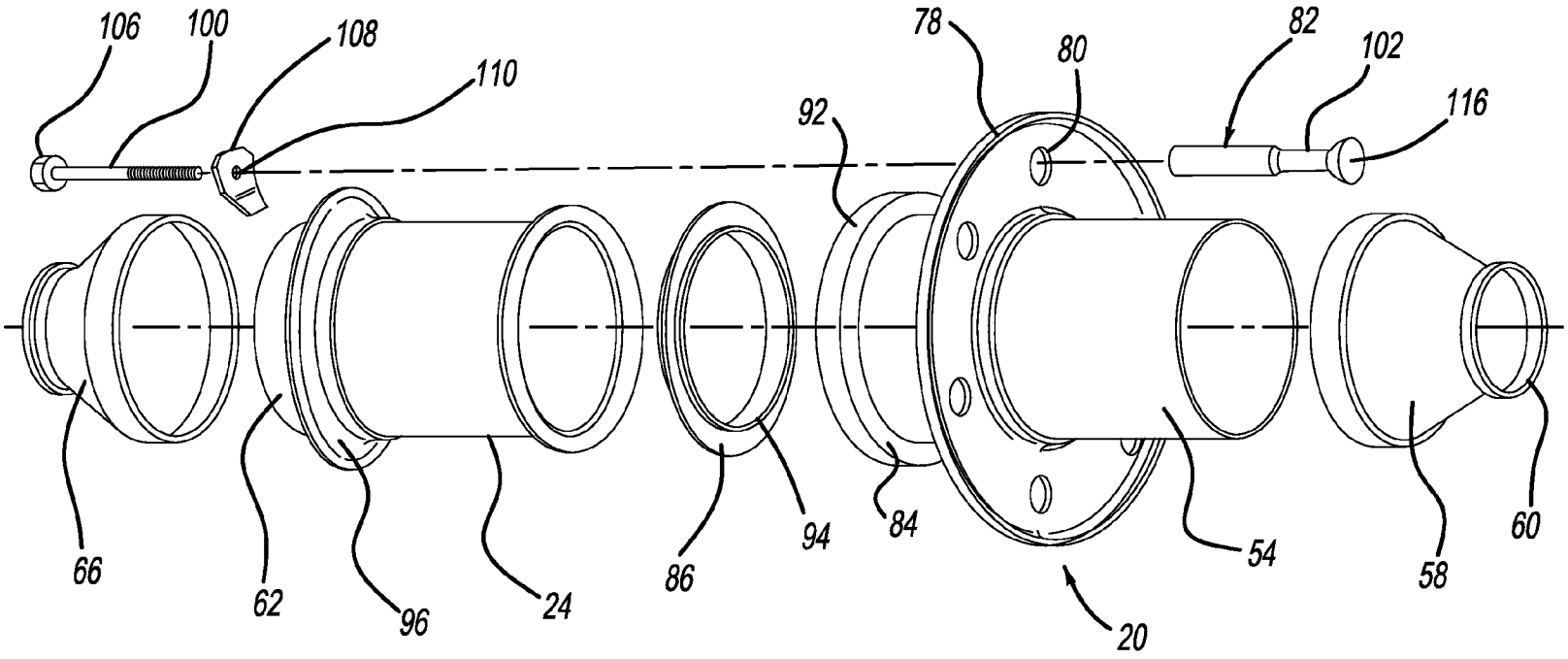
FIG. 2 is a cross-sectional view of a first exhaust treatment component according to a principle of the present disclosure.
Figure 3:
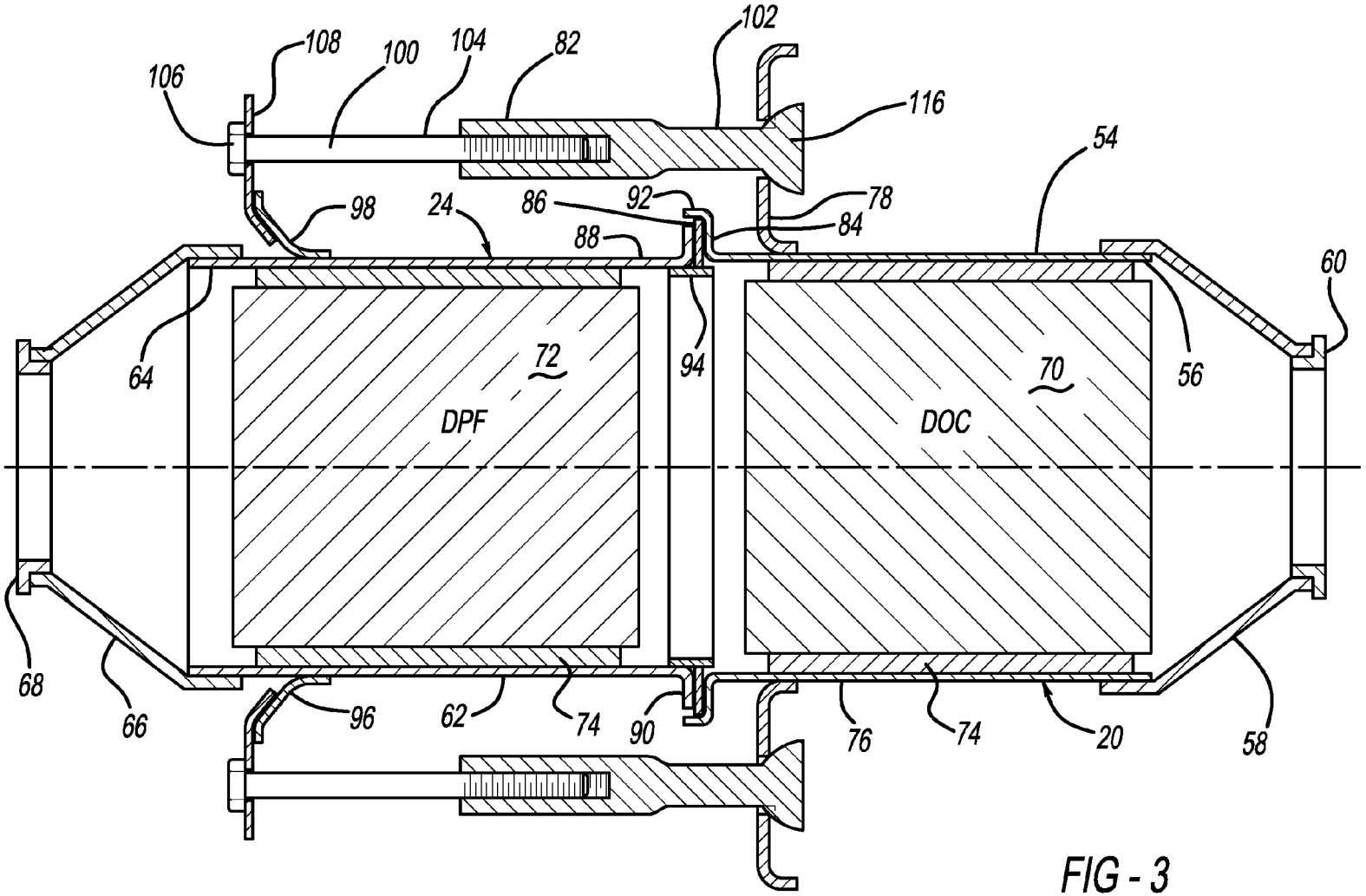
FIG. 3 is an exploded perspective view of the first exhaust treatment component illustrated in FIG. 2.

FIG. 1 schematically illustrates an exhaust system 10 according to the present disclosure. Exhaust system 10 can include at least an engine 12 in communication with a fuel source 14 that, once consumed, will produce exhaust gases that are discharged into an exhaust passage 16 having an exhaust after-treatment system 18. Downstream from engine 12 can be disposed a first exhaust treatment component 20, which in the illustrated embodiment can include a diesel oxidation catalyst (DOC) 22. A second exhaust treatment component 24 is coupled to first exhaust treatment component 20 by a coupling system 26, as will be described in more detail below. Second exhaust treatment component can be a diesel particulate filer (DPF) component 28.

Although not required by the present disclosure, exhaust after-treatment system 18 can further include components such as a thermal enhancement device or burner 30 to increase a temperature of the exhaust gases passing through exhaust passage 16. Increasing the temperature of the exhaust gas is favorable to achieve light-off of the catalyst in the exhaust treatment component 20 in cold-weather conditions and upon start-up of engine 12, as well as initiate regeneration of DPF 28.

To further assist in reduction of the emissions produced by engine 12, exhaust after-treatment system 18 can include a dosing module 32 for periodically dosing an exhaust treatment fluid into the exhaust stream. As illustrated in FIG. 1, dosing module 32 can be located upstream of a third exhaust treatment component 34, and is operable to inject an exhaust treatment fluid into the exhaust stream. In the illustrated embodiment, third exhaust treatment component 34 is a selective catalytic reduction (SCR) component 36. In this regard, dosing module 32 is in fluid communication with a reagent tank 38 and a pump 40 by way of inlet line 42 to dose an exhaust treatment fluid such as diesel fuel or urea into the exhaust passage 44 upstream of third exhaust treatment component 34. Dosing module 32 can also be in communication with reagent tank 38 via return line 46. Return line 46 allows for any exhaust treatment fluid not dosed into the exhaust stream to be returned to reagent tank 38. Flow of the exhaust treatment fluid through inlet line 42, dosing module 32, and return line 46 also assists in cooling dosing module 32 so that dosing module 32 does not overheat. Although not illustrated in the drawings, dosing module 32 can be configured to include a cooling jacket that passes a coolant around dosing module 32 to cool it.

The amount of exhaust treatment fluid required to effectively treat the exhaust stream may vary with load, engine speed, exhaust gas temperature, exhaust gas flow, engine fuel injection timing, desired $NO_x$ reduction, barometric pressure, relative humidity, EGR rate and engine coolant temperature. A $NO_x$ sensor or meter 48 may be positioned downstream from SCR 34. $NO_x$ sensor 48 is operable to output a signal indicative of the exhaust $NO_x$ content to an exhaust after-treatment system controller 50. All or some of the engine operating parameters may be supplied from an engine control unit 52 via the engine/vehicle databus to exhaust after-treatment system controller 50. The exhaust after-treatment system controller 50 could also be included as part of the engine control unit 52, without departing from the scope of the present disclosure. Exhaust gas temperature, exhaust gas flow and exhaust back pressure and other vehicle operating parameters may be measured by respective sensors, as indicated in FIG. 1.

The amount of exhaust treatment fluid required to effectively treat the exhaust stream can also be dependent on the size of the engine 12. In this regard, large-scale diesel engines used in locomotives, marine applications, and stationary applications can have exhaust flow rates that exceed the capacity of a single dosing module 32. Accordingly, although only a single dosing module 32 is illustrated for urea dosing, it should be understood that multiple dosing modules 32 for urea injection are contemplated by the present disclosure.

Now referring to FIGS. 2-5, first exhaust treatment component 20 can include a cylindrically-shaped housing 54. At a first end 56 of housing 54 can be attached an exhaust inlet 58. Exhaust inlet 58 can be conically-shaped, and can include at attachment ring 60 that can be bolted or fastened to an end of exhaust passage 16. Exhaust inlet 58 can be secured to first end 56 of housing 54 by welding, by using a clamp (not shown), or by any other attachment method known to one skilled in the art.

Second exhaust treatment component 24 can include a cylindrically-shaped canister 62. At a second end 64 of canister 62 can be attached an exhaust outlet 66. Similar to exhaust inlet 58, exhaust outlet 66 can be conically-shaped, and can include at attachment ring 68 that can be bolted or fastened to an end of exhaust passage 44. Exhaust outlet 66 can be secured to second end 64 of canister 62 by welding, by using a clamp (not shown), or by any other attachment method known to one skilled in the art.

First exhaust treatment component 20 houses a substrate brick 70. Because first exhaust treatment component 20 houses DOC 22, substrate brick 70 can be catalyst-coated to achieve oxidation of the exhaust gases passing therethrough. Second exhaust treatment component 24 also houses a substrate brick 72. Because second exhaust treatment component 24 houses DPF 28, substrate brick 72 can be a filter that is operable to filter soot and other particulate matter from the exhaust stream. Although exhaust treatment components 20 and 24 are illustrated as having a DOC 22 and DPF 28, respectively, the present disclosure should not be limited thereto. In this regard, exhaust treatment components 20 and 24 can house any combination of a DOC, DPF, SCR, lean $NO_x$ catalyst (LNC), ammonia slip catalyst, and the like. An insulating mat 74 can be disposed between bricks 70 and 72 and housing 54 and canister 62, respectively. Mat 74 prevents heat in exhaust treatment component 20 and 24 from escaping housing 54 and canister 62 so that the catalysts of DOC 22 and SCR 36 can remain at light-off temperature.

Housing 54 extends axially in a direction from exhaust inlet 58 toward exhaust outlet 66 of exhaust treatment components 20 and 24, respectively. At a position between first end 56 and a second end 76 of housing 54 can be disposed a radially outwardly extending flange 78. Flange 78 can extend about an entire circumference of housing 54, or be disposed intermittently at various positions about the circumference of housing 54. Flange 78 can include an aperture 80 for securing a tension rod assembly 82 of coupling system 26, as will be described in more detail later. Second end 76 of housing 54 can terminate at an L-shaped first gasket flange 84. First gasket flange 84 is designed to provide a sealing surface for a gasket 86 that can be disposed between housing 54 and canister 62 of exhaust treatment component 24.

Figure 4:
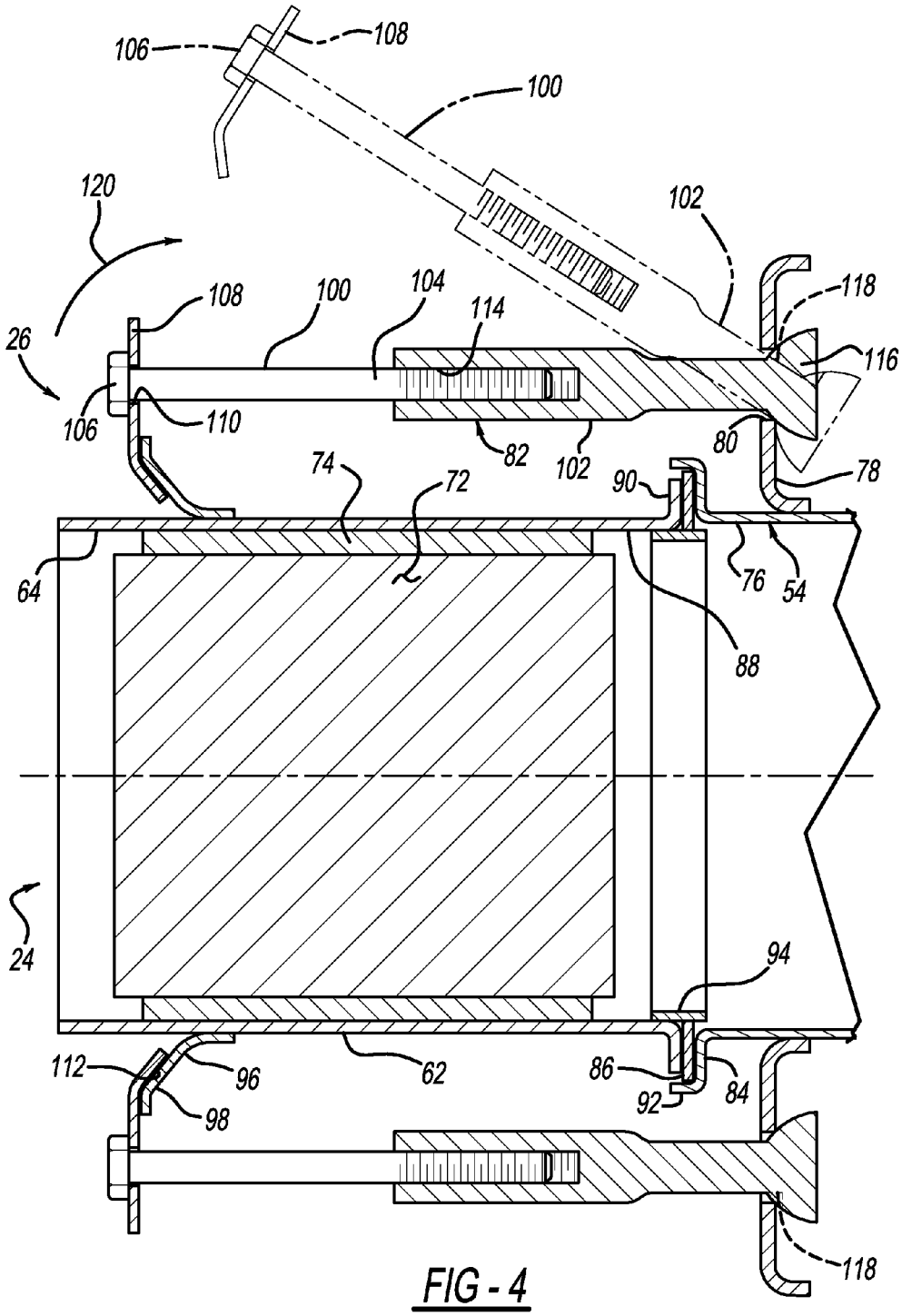
FIG. 4 is a partial cross-sectional view of the first exhaust component illustrated in FIG. 2, including an exhaust treatment component mounting system according to a principle of the present disclosure.
Figure 5:
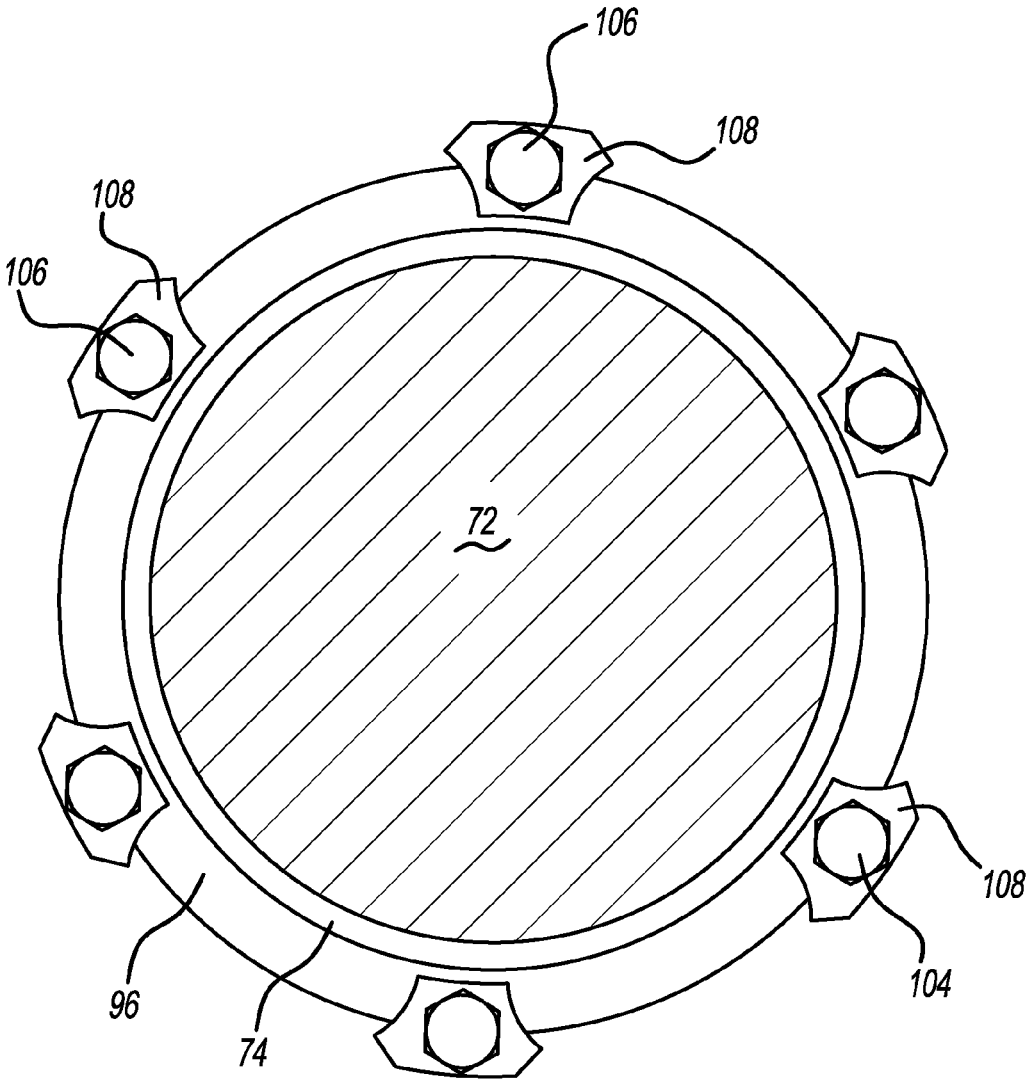
FIG. 5 is a partial front-perspective view of the exhaust treatment component mounting system of FIG. 4.

At a first end 88 of canister 62 can be formed a second gasket flange 90 that mates with first gasket flange 84 with gasket 86 therebetween. Second gasket flange 90 extends radially outward relative to canister 62. As shown in FIG. 4, second gasket flange 90 extends radially outwardly relative to canister 62 to a lesser extent than first gasket flange 84 extends radially outwardly relative to housing 54. In addition, first gasket flange 84 includes an axial component or circumferentially extending lip 92 that receives second gasket flange 90 with gasket 86 therebetween. Axial component 92 ensures that gasket 86 remains tightly secured between first and second gasket flanges 84 and 90. To secure gasket 86 between first and second gasket flanges 84 and 90, gasket 86 includes a gasket pilot ring 94 that extends axially relative to gasket 86. During assembly of exhaust treatment component 24 into annular housing 54, gasket pilot ring 94 including gasket 86 can first be seated against first gasket flange 84, and then canister 62 including second gasket flange 90 can be inserted to abut against gasket 86 and first gasket flange 84.

At a location between first end 88 and second end 64 of canister 62 can be disposed a cleat ring 96. Cleat ring 96 can extend about an entire circumference of canister 62, and may be fixed to canister 62 by welding, brazing, or any other attachment method known to one skilled in the art. As best shown in FIG. 4, cleat ring 96 extends radially outwardly relative to canister 62, and includes a radius of curvature 98 in the axial direction.

To secure canister 62 to housing 54, coupling system 26 including tension rod assembly 82 can be used. Tension rod assembly 82 includes first rod or male component 100 and a second rod or female component 102. Male component 100 can be in the form of a threaded bolt having a threaded shank portion 104 and a head portion 106. A retainer 108 includes a through-hole 110 formed in a base portion thereof in receipt of shank portion 104. Head portion 106 is restricted from passing through hole 110 thereby coupling one end of first rod 100 to retainer 108. Retainer 108 has a radius of curvature at an angled finger portion 112 that corresponds to that of cleat ring 96.

Female component 102 includes a threaded recess 114 for accepting and mating with threaded shank portion 104. At an end of female component 102 opposite to threaded recess 114, female component 102 can include a hemispherical-shaped bulb 116. Bulb 116 allows tension rod 82 to rotate away from canister 62 during insertion and removal of canister 62 from housing 54. Female component 102 is designed to feed through aperture 80 of flange 78, with bulb 116 having a diameter that is greater than that of aperture 80 that prevents female component 102 from feeding entirely through aperture 80, thereby coupling one end of second rod 102 to flange 78.

To secure first and second exhaust treatment components 20 and 24 together using mounting system 26, gasket pilot ring 94 including gasket 86 may first be seated against first gasket flange 84. Then, canister 62 may be mated with housing 54 such that gasket 86 is positioned between first and second gasket flanges 84 and 90. Female component 102 may then be fed through aperture 80, retainer 108 may be disposed about male component 100, and male component 100 mated with female component 102. As male component 100 is mated with female component 102, retainer 108 should be oriented to mate with cleat ring 86. As male component 100 is further tightened, the mating between coupling 108 and cleat ring 96 will pull canister 62 toward housing 54 to further compress gasket 86, which results in a hermetic seal between canister 62 and housing 54.

During tightening of male component 100 relative to female component 102, bulb 116 may be inclined to rotate in aperture 80. To prevent rotation of bulb 116 relative to aperture 80, bulb 116 may include an anti-rotation feature 118 that abuts flange 80. Anti-rotation feature 118 can be a notched portion formed in bulb 116. Outward from anti-rotation feature 118, however, bulb 116 should be a curved hemispherical surface to allow tension rod 82 to rotate relative to canister 62 during removal of canister 62 from annular housing 54, as shown in phantom in FIG. 4.

More particularly, during removal of canister 62 from housing 54, coupling system 26 is designed to allow for rotation (arrow 120) of tension rod 82 relative to canister 62 that allows for easier removal of canister 62 from housing 54. In this regard, as male component 100 is untightened from female component 102, the mating force between retainer 108 and cleat ring 96 will be removed. Once retainer 108 can be disengaged from cleat ring 96, tension rod 82 and retainer 108 can be rotated away from canister 62 to allow canister 62 to be gripped at cleat ring 96 and pulled outward from housing 54.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exhaust treatment component mounting system, comprising:

an exhaust treatment component canister containing a first substrate brick, the canister including a cleat ring;

an exhaust treatment component housing containing a second substrate brick, the housing including a radially outwardly extending flange; and a tension rod assembly including a first rod and a second rod, the first rod having a first end that mates with the flange of the housing, the second rod having a first end including a retainer that mates with the cleat ring, and second ends of the first and second rods being threadingly interconnected, wherein during interconnection between first and second rods, the canister is rigidly secured to the housing.

2. The exhaust treatment component mounting system of claim 1, wherein the second end of the second rod is a male component, and the second end of the first rod is a female component that mates with the male component.

3. The exhaust treatment component mounting system of claim 1, wherein the first end of the first rod includes a bulb portion.

4. The exhaust treatment component mounting system of claim 1, wherein each of the first substrate brick and the second substrate bricks are selected from the group consisting of a particulate filter and a catalyzed substrate.

5. The exhaust treatment component mounting system of claim 4, wherein the catalyzed substrate is a selective catalytic reduction (SCR) substrate or a diesel oxidant catalyst (DOC) substrate.

6. The exhaust treatment component mounting system of claim 1, further comprising a gasket positioned between the canister and the housing.

7. The exhaust treatment component mounting system of claim 6, wherein the housing includes a first gasket flange and the canister includes a second gasket flange, with the gasket positioned therebetween.

8. The exhaust treatment component mounting system of claim 7, wherein the first and second gasket flanges extend radially outwardly relative to the housing and canister, respectively.

9. The exhaust treatment component mounting system of claim 1, wherein each of the cleat ring and the retainer have a radius of curvature direction that correspond to each other.

10. An exhaust treatment component mounting system, comprising:

an exhaust treatment component canister, the canister including a cleat ring about a circumference thereof;

an exhaust treatment component housing including a radially outwardly extending flange about at least a portion thereof; and a coupling including a retainer, a first rod, and a second rod, a first end of the first rod being coupled to the flange of the housing and a first end of the second rod being coupled to the retainer, and second ends of the first and second rods being threadingly interconnected wherein relative rotation between the first rod and the second rod engages the retainer with the cleat ring to rigidly secure the canister to the housing.

11. The exhaust treatment component mounting system of claim 10, wherein the second end of the second rod is a male component, and the second end of the first rod is a female component that mates with the male component.

12. The exhaust treatment component mounting system of claim 10,wherein the first end of the first rod includes a bulb portion.

13. The exhaust treatment component mounting system of claim 12, wherein the bulb includes an anti-rotation feature.

14. The exhaust treatment component mounting system of claim 10,wherein each of the exhaust treatment component canister and housing include a substrate brick that is either a particulate filter or a catalyzed substrate.

15. The exhaust treatment component mounting system of claim 14, wherein the catalyzed substrate is a selective catalytic reduction (SCR) substrate or a diesel oxidation catalyst (DOC) substrate.

16. The exhaust treatment component mounting system of claim 10, further comprising a gasket positioned between the canister and the housing, and compressed by the coupling.

17. The exhaust treatment component mounting system of claim 16,wherein the housing includes a first gasket flange and the canister includes a second gasket flange, with the gasket secured therebetween.

18. The exhaust treatment component mounting system of claim 17, wherein the first and second gasket flanges extend radially outwardly relative to the housing and canister, respectively.

19. The exhaust treatment component mounting system of claim 18,wherein the first gasket flange includes a circumferentially extending lip that overlaps the second gasket flange with the gasket therebetween.

20. The exhaust treatment component mounting system of claim 10, wherein the retainer includes a curved surface and the cleat ring includes a curved seat, the curved surface being loaded in biased engagement with the curved seat.

21. The exhaust treatment component mounting system of claim 10, wherein the retainer includes a base portion including an aperture and an angled finger portion, the second rod extending through the aperture and the finger portion being selectively engageable with the cleat.

* * * * *